US010312584B2

(12) United States Patent
Chao

(10) Patent No.: US 10,312,584 B2
(45) Date of Patent: Jun. 4, 2019

(54) DUAL ANTENNA DEVICE

(71) Applicant: Lynwave Technology Ltd., New Taipei (TW)

(72) Inventor: Shih-Chieh Chao, Taoyuan (TW)

(73) Assignee: LYNWAVE TECHNOLOGY LTD., New Taipei (TW)

( * ) Notice: Subject to any disclaimer, the term of this patent is extended or adjusted under 35 U.S.C. 154(b) by 0 days.

(21) Appl. No.: 15/895,030

(22) Filed: Feb. 13, 2018

(65) Prior Publication Data

US 2019/0131700 A1 May 2, 2019

(30) Foreign Application Priority Data

Nov. 1, 2017 (TW) ..... 106216214 U

(51) Int. Cl.

*H01Q 1/24* (2006.01)
*H01Q 1/48* (2006.01)
*H01Q 1/52* (2006.01)
*H01Q 9/04* (2006.01)

(52) U.S. Cl.

CPC ..... *H01Q 1/523* (2013.01); *H01Q 1/241* (2013.01); *H01Q 1/48* (2013.01); *H01Q 9/04* (2013.01)

(58) Field of Classification Search

CPC .. H01Q 1/24; H01Q 1/52; H01Q 1/48; H01Q 1/523; H01Q 1/241

USPC ..... 343/844, 841

See application file for complete search history.

(56) References Cited

U.S. PATENT DOCUMENTS 6,392,605 B2 * 5/2002 Anterow ..... H01Q 1/243 343/700 MS
8,111,196 B2 * 2/2012 Thiara ..... H01Q 9/0414 343/700 MS
8,299,970 B2 * 10/2012 Hsu ..... H01Q 1/521 343/700 MS
8,866,692 B2 * 10/2014 Vazquez ..... H01Q 1/2291 343/702
9,627,747 B2 * 4/2017 Hong ..... H01Q 1/38
2002/0115436 A1 * 8/2002 Howell ..... B60R 25/102 455/426.1

(Continued)

FOREIGN PATENT DOCUMENTS

WO 2010028521 A1 3/2010

*Primary Examiner* — Lam T Mai

(74) *Attorney, Agent, or Firm* — Locke Lord LLP; Tim Tingkang Xia, Esq.

(57) ABSTRACT

A dual antenna device comprises a substrate, a first antenna, a second antenna and an isolation element. The substrate comprises an installation surface, the first antenna and the second antenna protrude from the installation surface and respectively couple to the installation surface by the first grounding edge and the second grounding edge. The isolation element comprises a first isolation portion protruding from the installation surface and coupling to the installation surface by a bottom side of the first isolation portion so that the first antenna and the second antenna respectively locate at both sides of the isolation element. The first antenna and the isolation element form a first interval in the extension direction of the first grounding edge. The second antenna and the isolation element form a second interval in the extension direction of the second grounding edge. The design of the isolation element improves the isolation magnitude.

16 Claims, 7 Drawing Sheets

(56) References Cited

U.S. PATENT DOCUMENTS

| | | | | |
|---|---|---|---|---|
| 2010/0328160 | A1* | 12/2010 | Hsu | H01Q 1/521<br>343/700 MS |
| 2011/0156963 | A1* | 6/2011 | Rajgopal | H01P 1/203<br>343/702 |
| 2013/0099992 | A1* | 4/2013 | Wu | H01Q 1/521<br>343/841 |
| 2014/0139392 | A1* | 5/2014 | Wong | H01Q 1/523<br>343/841 |
| 2017/0317419 | A1* | 11/2017 | Wu | H01Q 25/30 |

* cited by examiner

DUAL ANTENNA DEVICE

CROSS-REFERENCE TO RELATED APPLICATIONS

This non-provisional application claims priority under 35 U.S.C. § 119(a) on Patent Application No(s). 106216214 filed in Taiwan on Nov. 11, 2017, the entire contents of which are hereby incorporated by reference.

TECHNICAL FIELD

This disclosure relates to an antenna device, and more particularly to a dual antenna device applied in wireless communication equipment.

RELATED ART

The antenna is an important component is wireless communication products. The size and the performance of the antenna almost determine the quality of the wireless communication products. For example, the proposed specification of the fifth generation mobile network (5G) discloses that the available bandwidth is around 1 GHz at the band of 28 GHz. Single antenna already cannot completely cover such wide bandwidth. The common solution is to provide two antennas, one antenna for high band and another antenna for low band, and to use two channels to transmit the data. However, the development of wireless communication product is getting smaller and thinner. The limited size of device leads to the interference from one antenna to another antenna thus leading to the loss of transmission efficiency. Therefore, the isolation of antennas becomes an important indicator when designing the dual antenna or multi-antennas.

SUMMARY

According to one or more embodiments of this disclosure, a dual antenna device comprising a substrate comprising an installation surface; a first antenna comprising a first grounding edge, a first shorting edge and a first opening edge, wherein the first antenna protrudes from the installation surface and couples to the installation surface by the first grounding edge, wherein the first shorting edge couples to the first grounding edge and extends along a direction facing away from the installation surface, wherein the first opening edge is substantially in parallel to the first grounding edge and couples to the first shorting edge; a second antenna, comprising a second grounding edge, a second shorting edge and a second opening edge, wherein the second antenna protrudes from the installation surface and couples to the installation surface by the second grounding edge, wherein an extension direction of the second grounding edge and an extension direction of the first grounding edge form an angle, wherein the second shorting edge couples to the second grounding edge and extends along the direction facing away from the installation surface, wherein both the second shorting edge and the first shorting edge are located in a first reference plane, wherein the second opening edge is substantially in parallel to the second grounding edge and couples to the second shorting edge; and an isolation element, comprising a first isolation portion and a second isolation portion, wherein the isolation element protrudes from the installation surface and disposes in a second reference plane vertical to the substrate so that the first antenna and the second antenna respectively locate at both sides of the second reference plane, wherein the isolation element couples to the installation surface by a bottom side of the first isolation portion, wherein the isolation element and the first antenna form a first interval in the extension direction of the first grounding edge, wherein the isolation element and the second antenna form a second interval in the extension direction of the second grounding edge, wherein the second isolation portion couples to one side of the first isolation portion and passing through the first reference plane.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
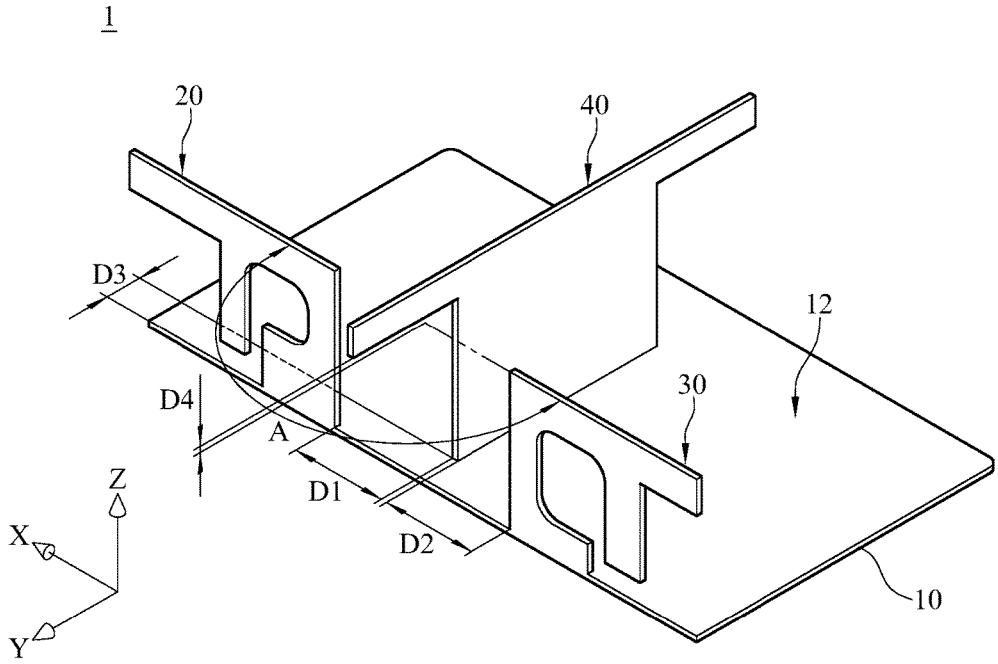
FIG. 1 is a perspective view of the dual antenna device according to an embodiment of the present disclosure.

A dual antenna device of the present disclosure is, for example, adapted to a wireless communication equipment. FIG. 1 is a perspective view showing an embodiment of the present disclosure. The dual antenna device 1 comprises a substrate 10, a first antenna 20, a second antenna 30 and an isolation element 40. As shown in FIG. 1, the substrate 10 is a rectangular structure with an installation surface 12 comprising two long edges and two short edges. Practically, depending on the real product, the substrate 10 may combine with a baffle or a fixing component. The substrate 10 can also have through holes based on the need for assembly. The substrate 10 of the present disclosure is not limited to the rectangular shape shown in FIG. 1.

Figure 2A:
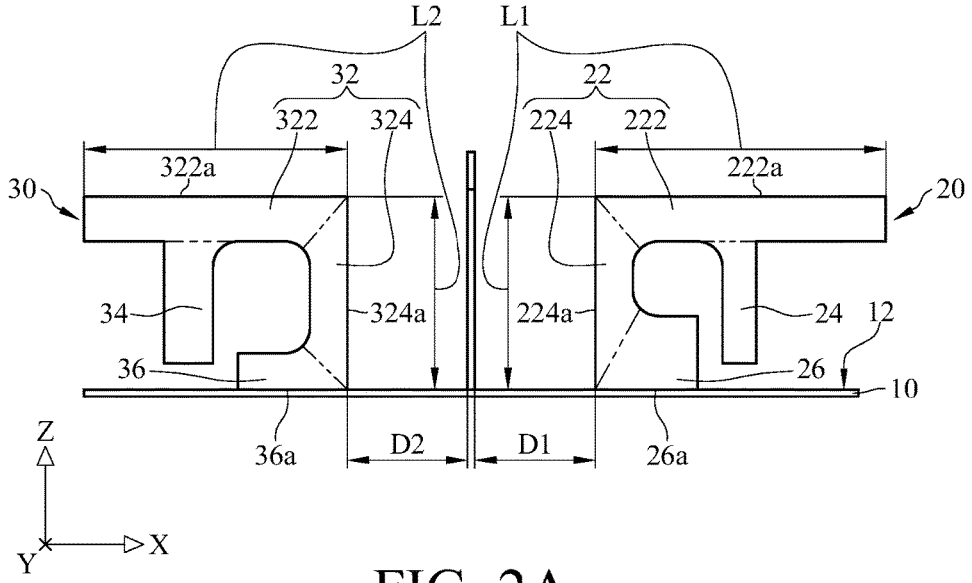
FIG. 2A is a is a front view of the dual antenna device directly facing the first reference plane according to an embodiment of the present disclosure.

Please refer to FIG. 2A. The first antenna 20 comprises a first radiation portion 22, a first feeding portion 24 and a first grounding portion 26. The first radiation portion 22 comprises a first opening branch 222 and a first shorting branch 224. The first opening branch 222 comprises a first opening edge 222*a*. The first shorting branch 224 comprises a first shorting edge 224*a*. The first grounding portion 26 comprises a first grounding edge 26*a*. One end of the first opening branch 222 and one end of the first shorting branch 224 form an L-shaped connection. The first radiation portion 22 comprises a first defined length L1 that is the sum of the length of the first opening edge 222*a* and the length of the first shorting edge 224*a*. Practically, the first defined length L1 is substantially 0.25 wavelength of the radio signal sent by the first antenna 20. One end of the first feeding portion 24 and one end of the first opening branch 222 form a T-shaped connection so that the first radiation portion 22 and the first feeding portion 24 form an F-shaped connection. One end of the first grounding portion 26 couples to another end of the first shorting branch 224 while said another end of the first shorting branch 224 does not couple to the first opening branch 222, and the first grounding portion 26 is substantially parallel to the first opening branch 222.

Please refer to FIG. 2A. The second antenna 30 comprises a second radiation portion 32, a second feeding portion 34 and a second grounding portion 36. The second radiation portion 32 comprises a second opening branch 322 and a second shorting branch 324.

The second opening branch 322 comprises a second opening edge 322*a*. The second shorting branch 324 comprises a second shorting edge 324*a*. The second grounding portion 36 comprises a second a grounding edge 36*a*. One end of the second opening branch 322 and one end of the second shorting branch 324 form an L-shaped connection.

The second radiation portion 32 comprises a second defined length L2 that is the sum of the length of the second opening edge 322*a* and the length of the second shorting edge 324*a*. Practically, the second defined length L2 is substantially 0.25 wavelength of the radio signal sent by the second antenna 30. One end of the second feeding portion 34 and one end of the second opening branch 322 form a T-shaped connection so that the second radiation portion 32 and the second feeding portion 34 form an F-shaped connection. One end of the second grounding portion 36 couples to another end of the second shorting branch 324 while said another end of the second branch 324 does not couple to the second opening branch 322, and the second grounding portion 36 is substantially parallel to the second opening branch 322. As set forth above, the second antenna 30 and the first antenna 20 have similar structures. It should be noticed that the realistic size of each component of the first antenna 20 and the second antenna 30 depends on the requirement of antenna design.

Please refer to FIG. 1 and FIG. 2A. The first antenna 20 protrudes from the installation surface 12 of the substrate 10 while the protruding direction is the extension direction of the first shorting edge 224*a*. In an embodiment of the present disclosure, the first shorting branch 224 is vertical to the installation surface 12 but the present disclosure is not thus limited. The first antenna 20 couples to the installation surface 12 by the first grounding edge 26*a* that is the bottom edge of the first grounding portion 26. One end of the first shorting edge 224*a* couples to the first grounding edge 26*a*, another end of the first shorting edge 224*a* couples to the first opening edge 222*a* of the first opening branch 222. The first opening edge 222*a* is the farthest edge of the first antenna 20 facing away from the installation surface 12.

Please refer to FIG. 1 and FIG. 2A. The second antenna 30 protrudes from the installation surface 12 of the substrate 10 while the protruding direction is the extension direction of the second shorting edge 324*a*. In an embodiment of the present disclosure, the second shorting branch 324 is vertical to the installation surface 12 but the present disclosure is not thus limited. The second antenna 30 couples to the installation surface 12 by the second grounding edge 36*a* that is the bottom edge of second grounding portion 36. One end of the second shorting edge 324*a* couples to the second grounding edge 36*a*, another end of the second shorting edge 324*a* couples to the second opening edge 322*a* of the second opening branch 322. The second opening edge 322*a* is the farthest edge of the second antenna 30 facing away from the installation surface 12. As set forth above, the connection manner between the second antenna 30 and the installation surface 12 is similar to the connection manner between the first antenna 20 and the installation surface 12, and the connection components of the second antenna 30 are named correspondingly to those of the first antenna 20. It should be noticed that the first antenna 20 and/or the second antenna 30 can have an angle with the installation surface 12 of the substrate 10 depending on the requirement of antenna design. The present of the invention does not limit that the first shorting branch 224 and/or the second shorting branch 324 must be vertical to the installation surface 12. In addition, in other embodiments, the design of the first grounding portion 26 can be not protruding from the first shorting branch 224 in the extension direction of the first grounding edge 26*a* while the design of the second grounding portion 36 can be not protruding from the second shorting branch 324 in the extension direction of the second grounding edge 36*a*.

Figure 2B:
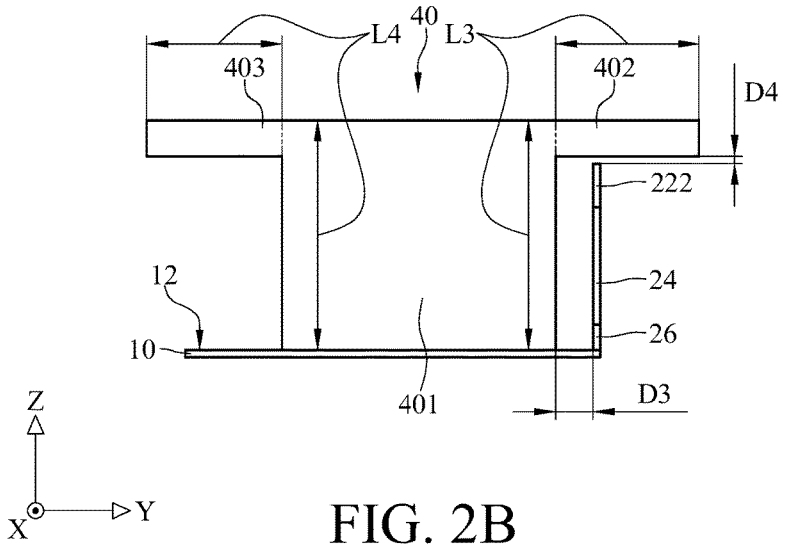
FIG. 2B is a side view of the dual antenna device directly facing the second reference plane according to an embodiment of the present disclosure.
Figure 2C:
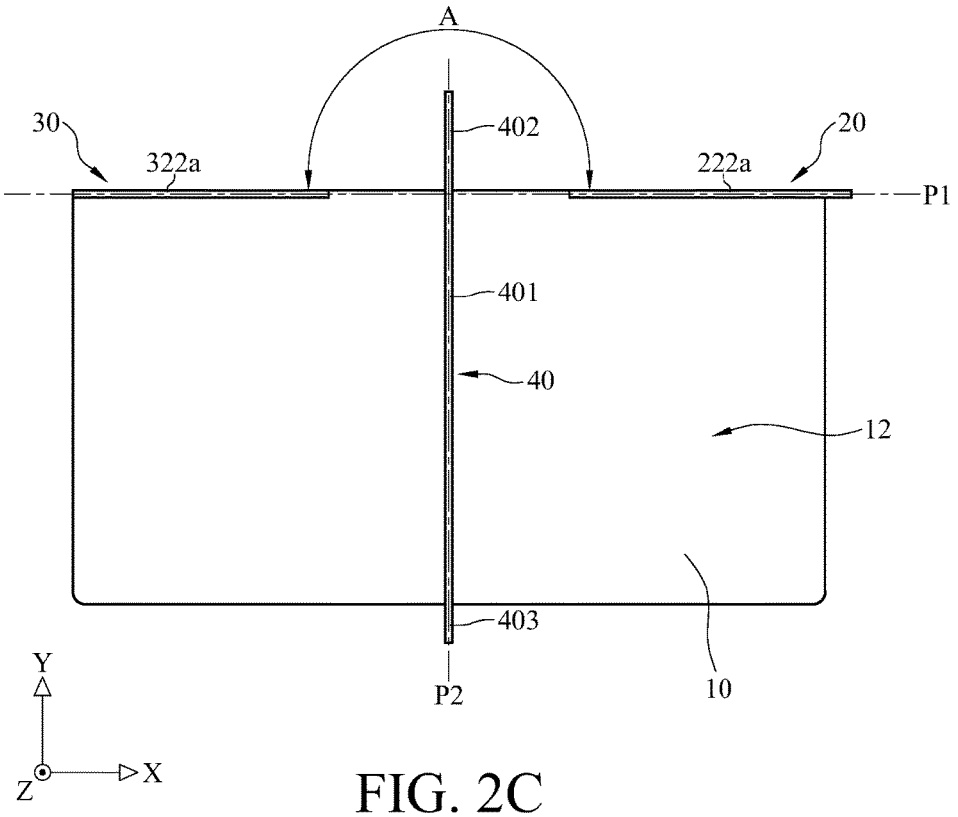
FIG. 2C is a top view of the dual antenna device directly facing the substrate according to an embodiment of the present disclosure.

Please refer to FIG. 1, FIG. 2A and FIG. 2C. The first shorting edge 224*a* and the second shorting edge 324*a* locate at the first reference plane P1. In the installation surface 12, the extension direction of the first grounding edge 26*a* and the extension direction of the second grounding edge 36*a* form an angle A. In an embodiment of the present disclosure, this angle is 180 degrees so that the first antenna 20 with the first grounding edge 26*a* and the second antenna 30 with the second grounding edge 36*a* are all in the first reference plane P1. The planar structures of first antenna 20 and the second antenna 30 are shown in FIG. 2A, with a view directly facing the first reference plane P1. Please refer to FIG. 2C. In an embodiment of the present disclosure, the extension direction of the first opening edge 222*a* and the extension of the second opening edge 322*a* form 180 degrees so that the first antenna 20 and the second antenna 30 do not interfere each other as much as possible when they send the radio signals in their own radiation direction.

In an embodiment of the present disclosure, the first antenna 20 is configured for high band transmission and the working frequency is 5.45-5.85 GHz, while the second antenna 30 is configured for low band transmission and the working frequency is 5.15-5.35 GHz.

The working frequencies of the first antenna 20 and the second antenna 30 are not limited to the above numbers. Practically, the length of the first feeding portion 24*a* can be adjusted shorter than the length of the second feeding portion 34 according to the different working frequencies of the first antenna 20 and the second antenna 30, but the present disclosure is not limited to the above adjustment. In other embodiments, the first antenna 20 and the second antenna 30 are configured to operate at the same working frequency, thus the length of the first feeding portion 24 is the same as the length of the second feeding portion 34.

Please refer to FIG. 1, FIG. 2B and FIG. 2C. For improving the isolation and adjusting the radiation direction of the dual antenna device 1, the dual antenna device 1 comprises an isolation element 40. The isolation element 40 protrudes from the installation surface 12 and disposes in the second reference plane P2 that is substantially vertical to the substrate 10. The first antenna 20 and the second antenna 30 respectively locate on both sides of the second reference plane P2, as shown in FIG. 2C. In a view directly facing the installation surface 12, the FIG. 2C shows that the isolation element 40 with a thickness is in the middle of the substrate 10, the first antenna 20 is on the right side of the isolation element 40, and the second antenna 30 is on the left side of the isolation element 40.

Please refer to FIG. 1 and FIG. 2B. The isolation element 40 comprises a first isolation portion 401, a second isolation portion 402 and a third isolation portion 403. In a view directly facing the second reference plane P2, the FIG. 2B shows that the planar shape of the isolation element 40, in an embodiment of the present disclosure, is substantially T-shape. The second isolation portion 402 couples to one side of the first isolation portion 401 and said one side is near to the first reference plane P1. The third isolation portion 403 couples to one side of the first isolation portion 401 and said one side is away from the first reference plane P1. The isolation element 40 couples to the installation surface 12 by a bottom side of the first isolation portion 401. The extension direction of the bottom side of the first isolation portion 401 is vertical to the connection direction of the first grounding edge 26*a* and the second grounding edge 36*a*, so that the isolation magnitude of the first antenna 20 and the second antenna 30 can be balanced. However, the present disclosure is not limited to the aforementioned vertical condition.

Please refer to FIG. 1 and FIG. 2A. In the extension direction of the first grounding edge 26*a*, there is a first interval D1 between and defined by the isolation element 40 and the first antenna 20. In the extension direction of the second grounding edge 36*a*, there is a second interval D2 between and defined by the isolation element 40 and the second antenna 30. In an embodiment of the present disclosure, the first interval D1 is 0.07-0.1 wavelength of a radio signal sent by the dual antenna device 1, and the second interval D2 is 0.07-0.1 wavelength of the radio signal sent by the dual antenna device 1. In this embodiment, the first antenna 20 and the second antenna 30 both are in the first reference plane P1, so the distance from the first shorting edge 224*a* to the second shorting edge 324*a* is 0.16-0.2 wavelength of the radio signal sent by the dual antenna device 1, while said distance is substantially the sum of the first interval D1, the second interval D2 and the thickness of the isolation element 40.

Please refer to FIG. 1 and FIG. 2B. In the extension direction of the bottom side of the first isolation portion, there is a third interval D3 between and defined by the bottom side of the first isolation portion 401 and the first grounding edge 26*a* or between and defined by the bottom side of the first isolation portion 401 and the second grounding edge 36*a*. In an embodiment of the present disclosure, the third interval D3 is 0.03-0.06 wavelength of the radio signal sent by the dual antenna device 1. The second isolation portion 402 passes through the first reference plane P1. Furthermore, there is a fourth interval D4 between and defined by a bottom side of the second isolation portion 402 and the first opening edge 222*a* or between and defined by the bottom side of the second isolation portion 402 and the second opening edge 322*a*. Said bottom side of the second isolation portion 402 faces the installation surface 12, and the fourth interval D4 lies in the extension direction of the first shorting edge 224*a* or in the extension direction of the second shorting edge 324*a*. From another perspective, the fourth interval D4 can be viewed as the difference of the perpendicular distance from the bottom side of the second isolation portion 402 to the installation surface 12 and the perpendicular distance from the first opening edge 222*a* or the second opening edge 322*a* to the installation surface 12. In an embodiment of the present disclosure, because the first shorting edge 224*a* and the second shorting edge 324*a* both are vertical to the installation surface 12 and have the same length, the distance from the bottom side of the second isolation portion 402 to the first opening edge 222*a* in the extension direction of the first shorting edge 224*a* and the distance from the bottom side of the second isolation portion 402 to the second opening edge 322*a* in the extension direction of the second shorting edge 324*a* are the same, which are 0.004-0.007 wavelength of the radio signal sent by the dual antenna device 1.

In other embodiments, if the height of the first antenna 20 and the height of the second antenna 30 are different, then the fourth interval D4 is set as a smaller one of the distances between the bottom side of the second isolation portion 402 and the first opening edge 222*a* and between said bottom side and the second opening edge 322*a*.

Please refer to FIG. 2B. The first isolation portion 401 and the second isolation portion 402 form a third defined length L3. The third defined length L3 is the sum of the perpendicular distance from the first isolation portion 40 to the installation surface 12 and the length of the second isolation portion 402 that is substantially parallel to the installation surface 12. The first isolation portion 401 and the third isolation portion 403 form a fourth defined length L4. The fourth defined length L4 is the sum of the perpendicular distance from the first isolation portion 401 to the installation surface 12 and the length of the third isolation portion 403 that is substantially parallel to the installation surface 12. In an embodiment of the present disclosure, the third defined length L3 and the fourth defined length L4 both are 0.25 wavelength of the radio signal sent by the dual antenna device 1.

Figure 3:
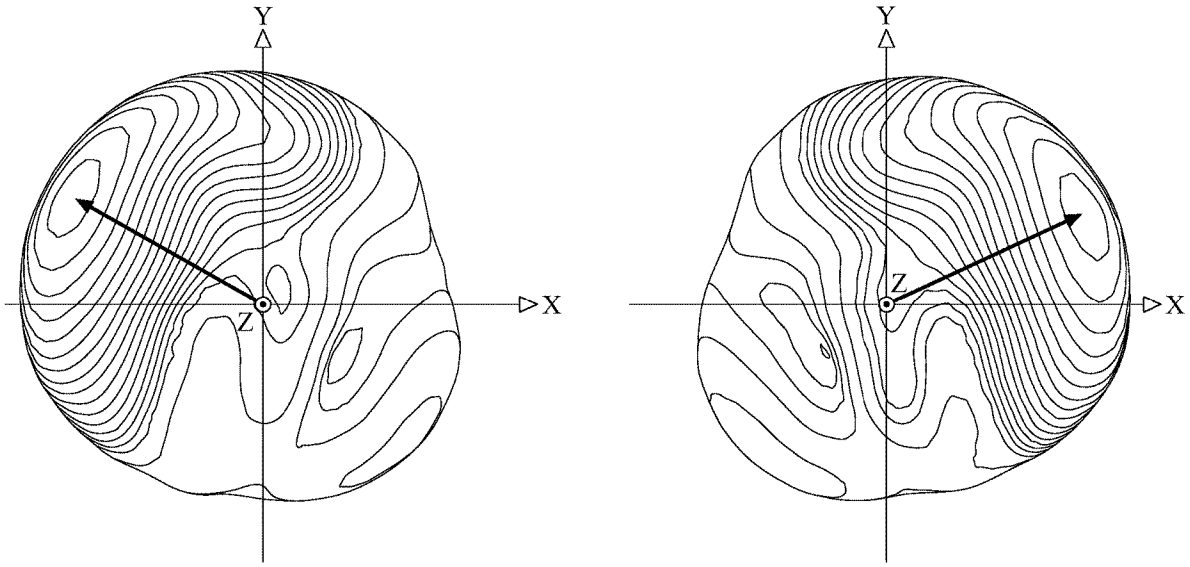
FIG. 3 is a graphical representation of the radiation pattern of the dual antenna device according to an embodiment of the present disclosure.

Please refer to FIG. 3. FIG. 3 shows two radiation patterns of the dual antenna device 1 in the perspective of the x-y plane. Specifically, the right graph is the pattern of the first antenna 20 and the left graph is the pattern of the second antenna 30. Practically, by adjusting the feeding current of the first feeding portion 24 and the second feeding portion 34, the first antenna 20 and the second antenna 30 have opposite phases with the same magnitude of the amplitude of radio wave. Meanwhile, according to an embodiment of the present disclosure, due to the size of isolation element 40 (the third defined length L3 and the fourth defined length L4), the distance relationship among the isolation element 40, the first antenna 20 and the second antenna 30 (the first interval D1, the second interval D2, the third interval D3 and the fourth interval D4), the lengths/interval settings stated above, part of the radiation range of the first antenna 20 can cancel out part of the radiation range of the second antenna 30. The canceled parts are located at one side of the first isolation portion 401, which is the side connected to the second isolation portion 402. As shown in FIG. 3, the radiation range of the first antenna 20 at its 9-10 o'clock and the radiation range of the second antenna 30 at its 2-3 o'clock direction have obviously hollow parts. According to the above descriptions and FIG. 3, it shows the effect of isolation element 40 in the present disclosure. Moreover, since the effect levels of isolation resulted from the first isolation portion 401 and the second isolation portion 402 are different, the isolation element 40 has the effect of enabling the independent adjustment of the radiation directions of the two antennas. In FIG. 2C which has the same perspective as FIG. 3 to the dual antenna device 1, the radiation direction of the first antenna 20 is about 2 o'clock direction thereof as the arrow shown in FIG. 3, and the radiation direction of the second antenna 30 is about 10 o'clock direction thereof as the arrow shown in FIG. 3. The radiation directions stated above are affected by the isolation element 40 disposed along the y-axis in FIG. 3.

Figure 5:
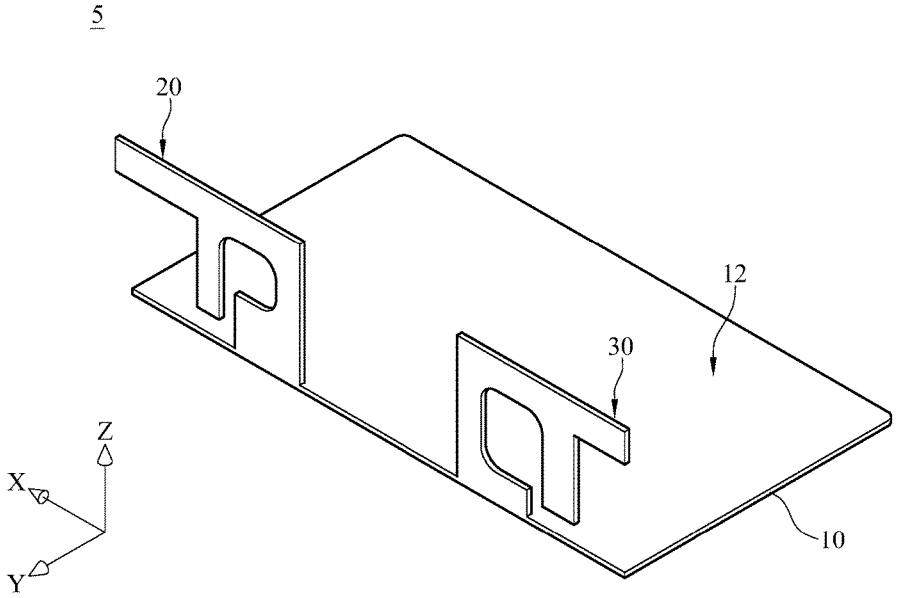
FIG. 5 is a perspective view of the dual antenna without the isolation element.
Figure 6:
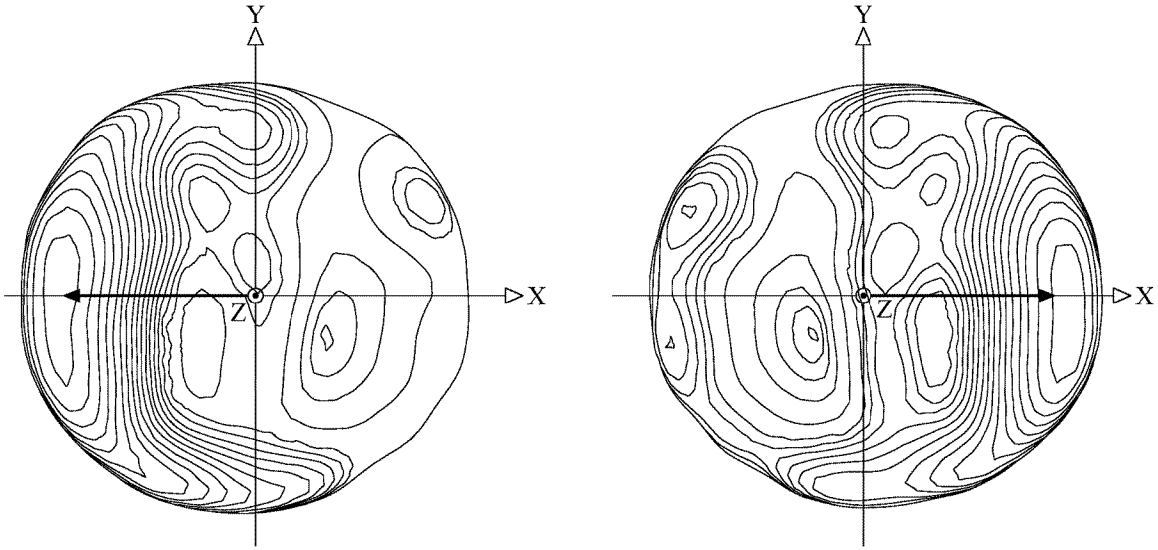
FIG. 6 is a graphical representation of the radiation pattern of the dual antenna device without the isolation element.

Please refer to the FIG. 5, it shows an embodiment of the present disclosure but the isolation element 40 is removed. Please refer to FIG. 6 and FIG. 3. FIG. 6 is a simulation result according to the dual antenna device 5 in FIG. 5. Compared to the dual antenna device 1 with the isolation element 40, the radiation pattern in FIG. 6 does not have hollow parts as the radiation pattern shown in FIG. 3. The radiation direction of first antenna 20 extends in 3 o'clock direction thereof and the radiation of second antenna 30 extends in 9 o'clock direction thereof.

Figure 4:
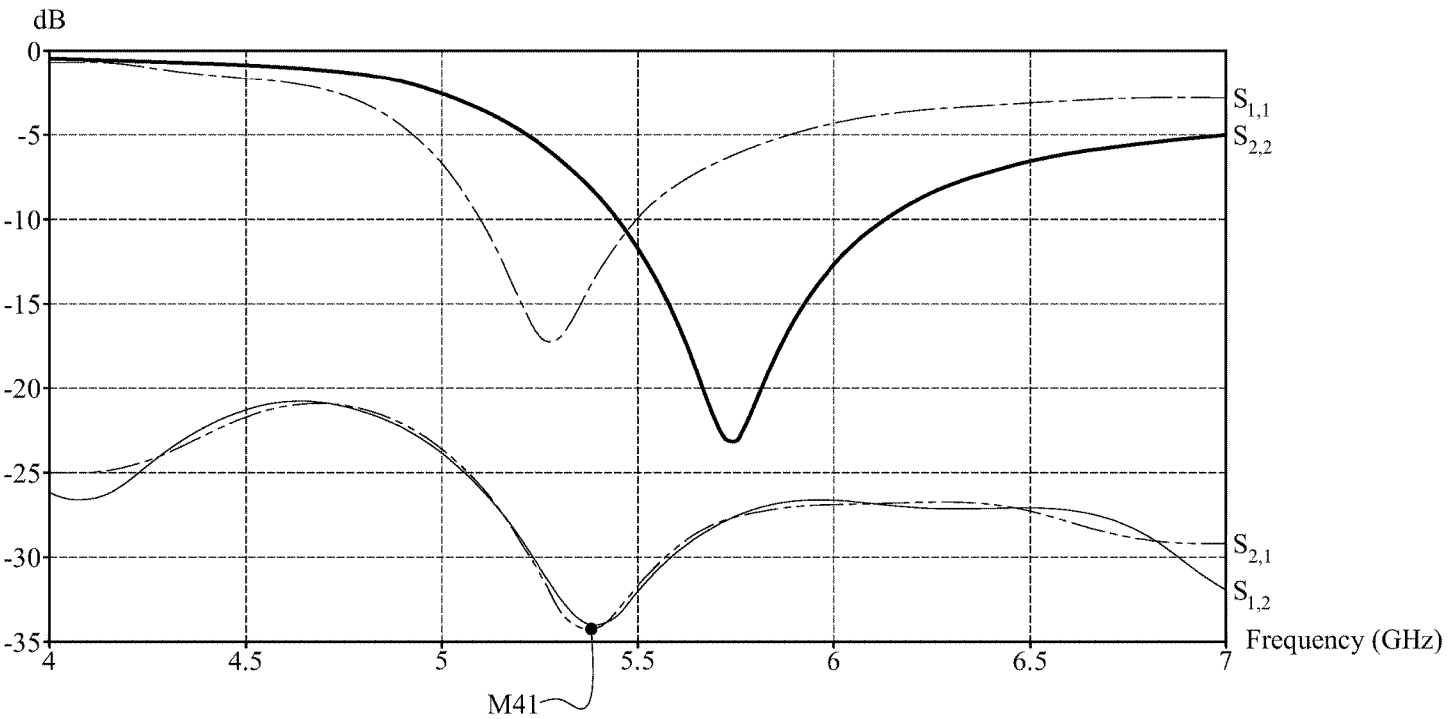
FIG. 4 is a diagram of the isolation of the dual antenna device according to an embodiment of the present disclosure.
Figure 7:
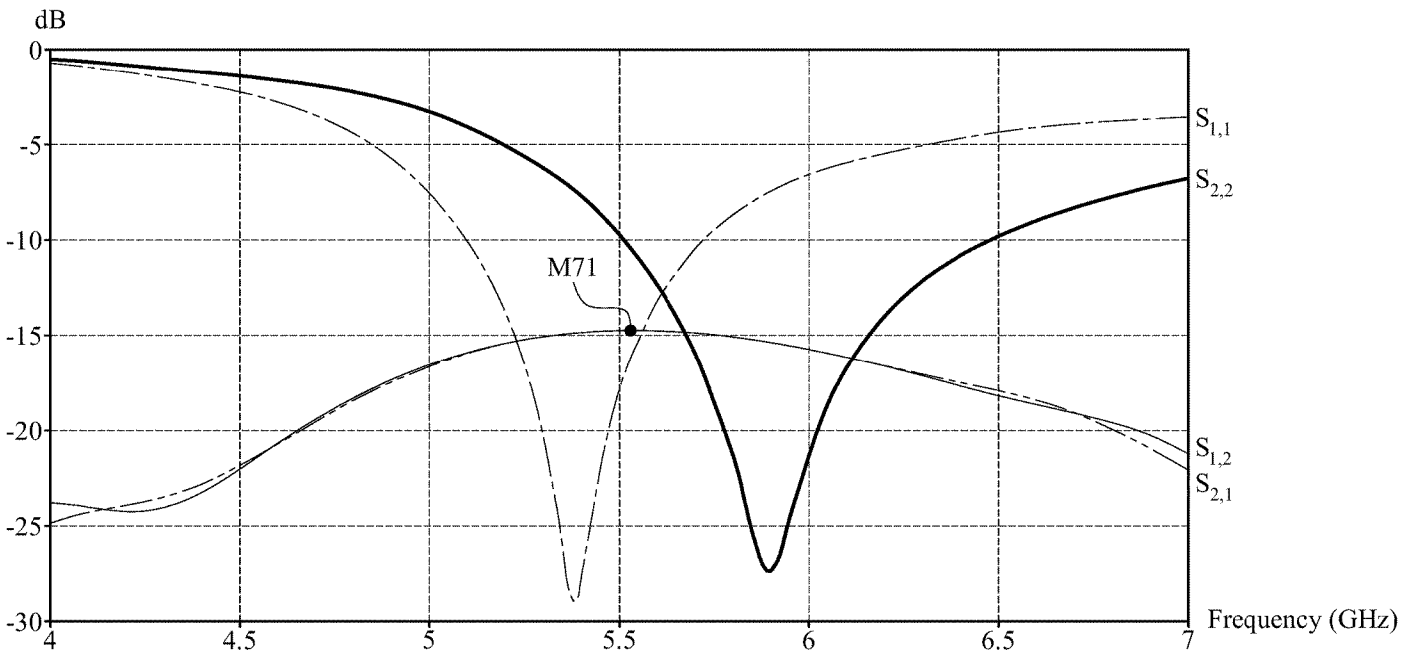
FIG. 7 is a diagram of the isolation of the dual antenna device without the isolation element.

FIG. 4 shows the S-parameter of an embodiment of the present disclosure. FIG. 7 shows the S-parameter of an embodiment of the present disclosure without the isolation element 40. According to the number variation of S2,1 and S1,2 under the different frequencies, it is obvious that the isolation element 40 of the present disclosure improves the isolation magnitude from −14.5 dB (marked as M71) to −33.5 dB (marked as M41).

In an embodiment of the present disclosure, the substrate 10, the first antenna 20, the second antenna 30 and the isolation element 40 are integrally formed by the conductive material such as metal. For example, the planar structures of the first antenna 20 and the second antenna 30 can be processed additionally when manufacturing the substrate 10.

The first antenna 20 and the second antenna 30 protrude from the installation surface 12 of substrate 10 after bending said planar structures, as three-dimensional structure shown in FIG. 1. The isolation element 40 can also be formed by bending the substrate 19 after cutting the first isolation portion 401, the second isolation portion 402 and the third isolation portion 403 from the substrate 10, so that the isolation element 40 protrudes from the installation surface 12, as the three-dimensional structure shown in FIG. 1.

However, the method of manufacturing the dual antenna device 1 does not limit by the above descriptions. Practically, after the manufacture work of the first antenna 20, the second antenna 30 and the isolation element 40 are done, the dual antenna device 1 can be formed by the combination of these components.

In sum, the dual antenna device of the present disclosure comprises the isolation element with a specific structure between the first antenna and the second antenna and the isolation element has the first/second interval related to the first/second antenna so that the isolation magnitude can be improved and the radiation direction can be adjusted when the dual antenna device is applied in small size antenna.

What is claimed is:

1. A dual antenna device, comprising:

a substrate comprising an installation surface;

a first antenna comprising a first grounding edge, a first shorting edge and a first opening edge, wherein the first antenna protrudes from the installation surface and couples to the installation surface by the first grounding edge, wherein the first shorting edge couples to the first grounding edge and extends along a direction facing away from the installation surface, wherein the first opening edge is substantially in parallel to the first grounding edge and couples to the first shorting edge;

a second antenna, comprising a second grounding edge, a second shorting edge and a second opening edge, wherein the second antenna protrudes from the installation surface and couples to the installation surface by the second grounding edge, wherein an extension direction of the second grounding edge and an extension direction of the first grounding edge form an angle, wherein the second shorting edge couples to the second grounding edge and extends along the direction facing away from the installation surface, wherein both the second shorting edge and the first shorting edge are located in a first reference plane, wherein the second opening edge is substantially in parallel to the second grounding edge and couples to the second shorting edge; and an isolation element, comprising a first isolation portion and a second isolation portion, wherein the isolation element protrudes from the installation surface and disposes in a second reference plane vertical to the substrate so that the first antenna and the second antenna respectively locate at both sides of the second reference plane, wherein the isolation element couples to the installation surface by a bottom side of the first isolation portion, wherein the isolation element and the first antenna form a first interval in the extension direction of the first grounding edge, wherein the isolation element and the second antenna form a second interval in the extension direction of the second grounding edge, wherein the second isolation portion couples to one side of the first isolation portion and passing through the first reference plane.

2. The dual antenna device of claim 1, wherein:

the first antenna further comprises a first radiation portion, a first feeding portion and a first grounding portion, wherein the first radiation portion comprises a first shorting branch and a first opening branch, with one end of the first shorting branch coupling to the first grounding portion and another end of the first shorting branch coupling to the first opening branch to form an L-shaped connection, wherein the first shorting edge is a closest edge of the first shorting branch to the isolation element while the first opening edge is a farthest edge of the first opening branch to the installation surface, wherein the first feeding portion couples to the first opening branch to form a T-shaped connection; and the second antenna further comprises a second radiation portion, a second feeding portion and a second grounding portion, wherein the second radiation portion comprises a second shorting branch and a second opening branch, with one end of the second shorting branch coupling to the second grounding portion and another end of the second shorting branch coupling to the second opening branch to form an L-shaped connection, wherein the second shorting edge is a closest edge of the second shorting branch to the isolation element while the second opening edge is the farthest edge of the second opening branch to the installation surface, wherein the second feeding portion couples to the second opening branch to form a T-shaped connection.

3. The dual antenna device of claim 1, wherein the angle is 180 degrees.

4. The dual antenna device of claim 1, wherein a distance between the first shorting edge and the second shorting edge is 0.16-0.2 wavelength of a radio signal sent by the dual antenna device.

5. The dual antenna device of claim 1, wherein the first interval is 0.07-0.1 wavelength of a radio signal sent by the dual antenna device.

6. The dual antenna device of claim 1, wherein the second interval is 0.07-0.1 wavelength of a radio signal sent by the dual antenna device.

7. The dual antenna device of claim 1, wherein a bottom side of the first isolation portion and one of the first grounding edge and the second grounding edge in the extension direction of the bottom side of the first isolation portion form a third interval.

8. The dual antenna device of claim 7, wherein the third interval is 0.03-0.06 wavelength of a radio signal sent by the dual antenna device.

9. The dual antenna device of claim 1, wherein a bottom side of the second isolation portion and the first opening edge in the extension direction of the first shorting edge or the bottom side of the second isolation portion and the second opening edge in the extension direction of the second shorting edge form a fourth interval.

10. The dual antenna device of claim 9, wherein the fourth interval is 0.004-0.007 wavelength of a radio signal sent by the dual antenna device.

11. The dual antenna device of claim 1, wherein the isolation element comprises a third isolation portion, with the third isolation portion coupling to one side of the first isolation portion, and the third isolation portion and the second isolation portion are symmetrically disposed.

12. The dual antenna device of claim 2, wherein the first radiation portion comprises a first defined length and the second radiation portion comprises a second defined length, both the first defined length and the second defined length are substantially 0.25 wavelength of a radio signal sent by the dual antenna device.

13. The dual antenna device of claim 11, wherein the isolation portion comprises a third defined length from the first isolation portion to the second isolation portion and a fourth defined length from the first isolation portion to the third isolation portion, wherein the third defined length and the fourth defined length are substantially 0.25 wavelength of a radio signal sent by the dual antenna device.

14. The dual antenna device of claim 1, wherein the substrate, the first antenna, the second antenna and the isolation portion are integrally formed.

15. The dual antenna device of claim 1, wherein the first shorting edge and the second shorting edge are vertical to the installation surface.

16. The dual antenna device of claim 2, wherein the first feeding portion and the second feeding portion have different lengths.

* * * * *